United States Patent [19]

Connin

[11] 4,099,860

[45] Jul. 11, 1978

[54] COPIER/DUPLICATOR PRIORITY INTERRUPT APPARATUS

[75] Inventor: John L. Connin, Canandaigua, N.Y.

[73] Assignee: Eastman Kodak Company, Rochester, N.Y.

[21] Appl. No.: 739,895

[22] Filed: Nov. 8, 1976

[51] Int. Cl.[2] ..... G03G 21/00

[52] U.S. Cl. ..... 355/14

[58] Field of Search ..... 355/14

[56] References Cited

U.S. PATENT DOCUMENTS

| | | | |
|---|---|---|---|
| 3,876,106 | 4/1975 | Powell et al. | 355/14 X |
| 3,914,047 | 10/1975 | Hunt et al. | 355/14 X |
| 3,917,396 | 11/1975 | Donohue et al. | 355/14 |
| 3,970,384 | 7/1976 | Yamamoto et al. | 355/14 |

*Primary Examiner*—A. D. Pellinen
*Attorney, Agent, or Firm*—Raymond L. Owens

[57] ABSTRACT

For use with a copier/duplicator adapted to produce production runs having predetermined multiple copies of documents, priority interrupt apparatus which stops a first lower priority production run and stores in a memory the remaining number of copies of the first production run which has to be made plus other desired pertinent machine status information. The copier/duplicator then proceeds to produce higher priority production runs. After the higher priority runs are completed, the priority interrupt apparatus causes the copier/duplicator to complete the remaining copies of the first production run.

3 Claims, 10 Drawing Figures

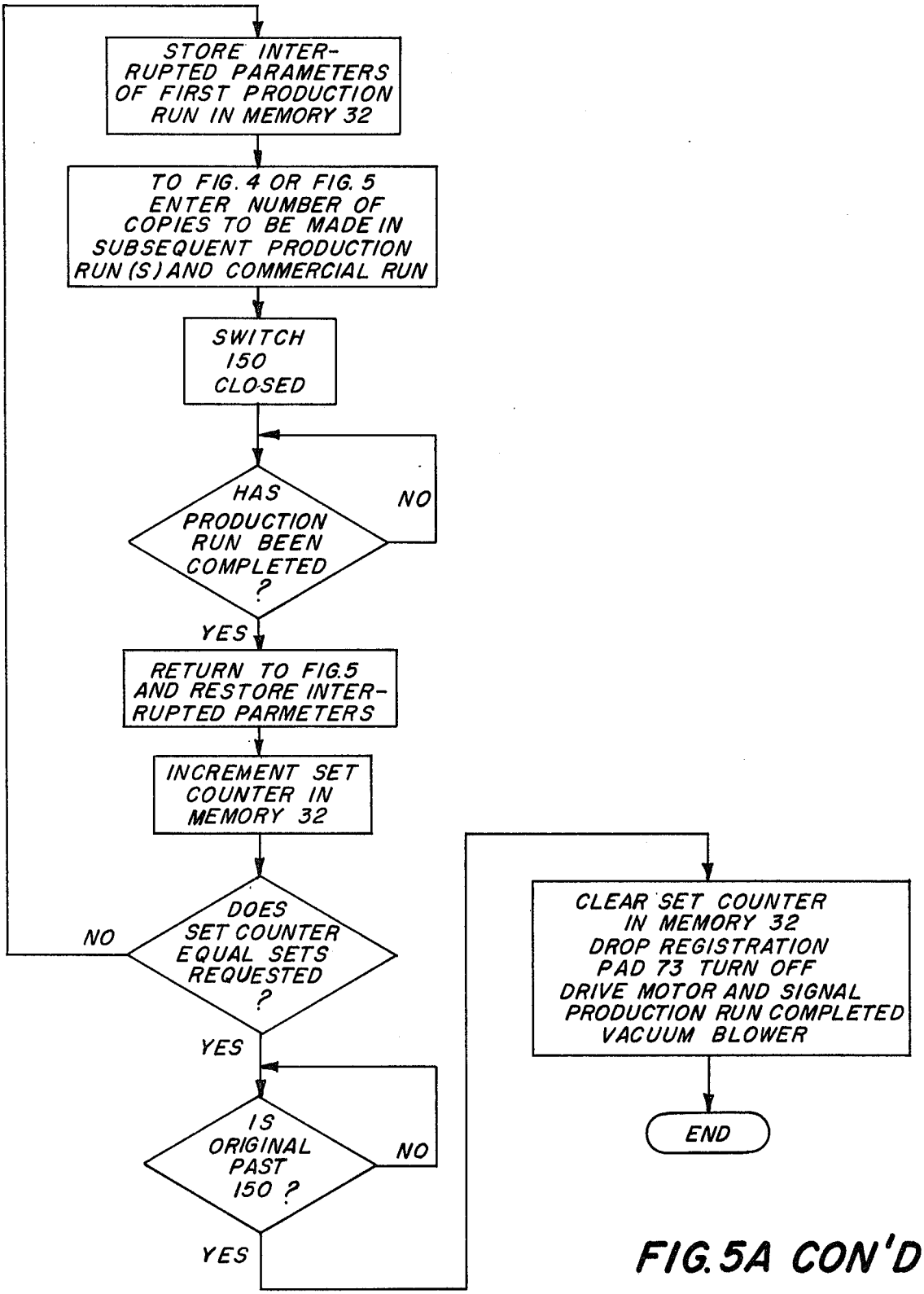
FIG. 5A CON'D

COPIER/DUPLICATOR PRIORITY INTERRUPT APPARATUS

CROSS REFERENCED TO RELATED APPLICATIONS

Reference should be had to commonly assigned, copending United States Patent Application Ser. No. 671,867, now U.S. Pat No. 4,078,787, the disclosure of which is incorporated herein, entitled: Automatic Transfer From Collate to Noncollate Mode of Recirculating Feeder and Copier Operation, filed: July 27, 1976, in the names of L. Burlew et al.

BACKGROUND OF THE INVENTION

1. Field of the Invention

This invention relates to apparatus for interrupting the operation of a copy/duplicator as it produces a first production run, causes it to complete higher priority production runs and thereafter automatically reinstating the status to complete the remaining copies of the first production run which was interrupted.

2. Description of the Prior Art

Frequently it is necessary to interrupt a production run of a copy/duplicator in mid-stream so that a job or production run of higher priority can be processed.

After the higher priority production runs have been completed, the operator must either completely re-run the interrupted production run or re-arrange the documents which remain to be copied, calculate the number of remaining copies to be made in the run and program the copier/duplicator accordingly. In such a situation, there is a problem of possible copy paper waste, operator calculation errors and setup errors. This problem is particularly troublesome when the copier/duplicator employs a recirculating feeder.

A recirculating feeder can selectively make either collate or noncollate copies of documents. As is disclosed in U.S. Pat. No. Re. 27,976 and Application Ser. No. 523,610 now abandoned, by using a recirculating feeder, several collate copies of a multi-page original document can be produced by a copy/duplicator. Such a recirculating feeder feeds individual sheets in succession from the bottom of a stack to the exposure platen and returns such sheet to the top of the stack while maintaining the original orientation. After each of the sheets have been fed once, they can either be fed again or be removed from the feeder. Therefore, if the feeder is in the collate mode of operation, and since the copy pages are delivered from the copier in the same order as the original pages, collation of the copy pages by a sorter accessory in unnecessary.

Occasionally, a sheet of a document will jam in the recirculating feeder. If it is wrinkled, it is removed from the feeder smoothed out, and a master copy of it is made on the copy/duplicator. This copy master is then returned to the appropriate position in the stack of the original documents. The operator now must calculate the remaining copies or sets to be made and program the copy/duplicator with this information. In this situation, there is as noted above, a likelihood of operator calculation error.

SUMMARY OF THE INVENTION

In accordance with the invention, priority interrupt apparatus is disclosed which causes a copier/duplicator to stop a first production run and store in memory the remaining number of copies of the run to be made.

Thereafter the higher production runs are made. When the first production run is to be finished, the priority interrupt apparatus causes the remaining number of copies of the first run to be made, thereby obviating the need for operator calculations.

The disclosed embodiment of the invention is shown for use with a recirculating feeder. If a master copy of a jammed document sheet has to be made, this situation is handled by the priority interrupt apparatus as a higher priority production run where only a single copy has to be made in such run. As set forth in more detail in the section of this application entitled: "Description of the Preferred Embodiment", the priority interrupt apparatus operates effectively with recirculating feeders and copier/duplicator irrespective of whether they operate in collate or noncollate modes of operation.

An advantage of the invention is that with the disclosed priority interrupt apparatus billing data for the interrupted run can be reinstated after interruption. This may result in a lower cost to customers, if they lease the copy/duplicator, since the continuation of the run need not be treated as a separate billing job. Thus under the usual billing condition where the billing rate per copy is a decreasing function depending on the number of copies made in a production run there will be lower overall user cost for an interrupted run where it is not treated as a separate billing job.

BRIEF DESCRIPTION OF THE DRAWINGS

For a more complete understanding of the instant invention as well as its advantages and features, the invention will be described in conjunction with the accompanying drawings, in which.

DESCRIPTION OF THE PREFERRED EMBODIMENT

Before proceeding with a detailed description of the preferred embodiment, first consider an electrophotographic copier, and a logic and control unit which may be used in accordance with this invention. Thereafter, the priority interrupt apparatus will be set forth.

Although the preferred embodiment is particularly well suited for use in a feeder coupled to an electrophotographic copier, the priority interrupt apparatus could be used with equal facility and advantage in any number of other copying, duplicating, or reproducing machines.

In this disclosure, the feeder is said to be able to operate in a collate or noncollate mode. Of course, it will be understood that the feeder must be coupled to a copier for copies to be made. Thus, it is the feeder and the copier which actually function in these modes of operation. Moreover, the term "document" refers to all the sheets or originals which are in the feeder and are to be copied. The term "copy sheet" refers to the output of the copier.

Electrophotographic Copier and Logic and Control Unit

Figure 1:
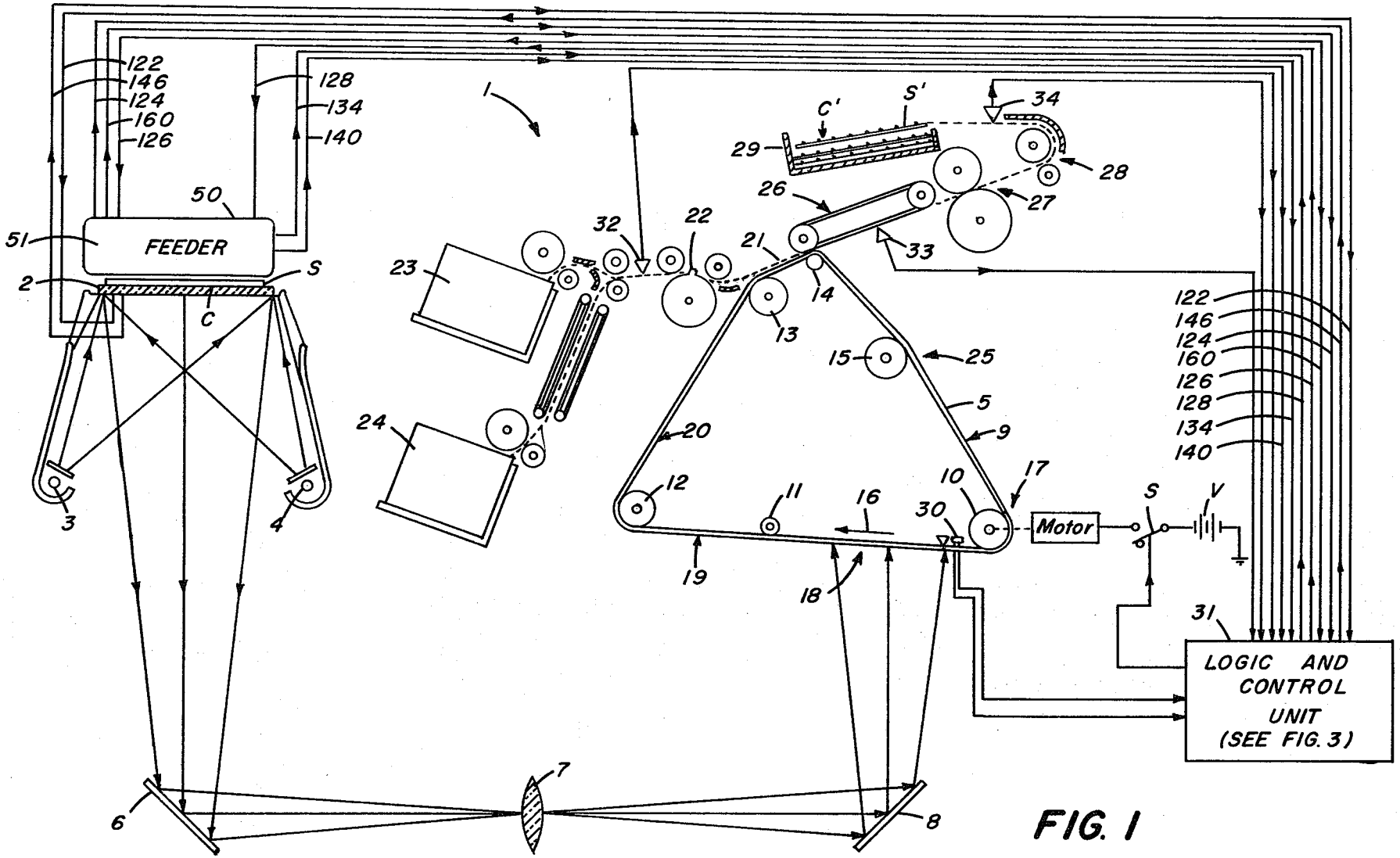
FIG. 1 is a schematic front elevation view of the apparatus including a web-type electrophotographic copier and a recirculating feeder.

Referring now to the drawings and in particular to FIG. 1, there is schematically illustrated an electrophotographic copy/duplicator hereinafter referred to as the copier. Only those features of the copier which are helpful for a full understanding of the preferred embodiment are described hereinafter. However, a more complete description of the copier may be found in commonly assigned U.S. Pat. No. 3,914,047, patented: Oct. 21, 1975, in the names of Hunt et al.

To copy a selected side C of a sheet of an original document S using the copier 1, the original sheet is placed with the selected side C facing an exposure platen 2 constructed of transparent glass. When energized, two xenon flash lamps 3 and 4 illuminate the selected side C of the original sheet S. By means of an object mirror 6, a lens 7, and an image mirror 8, a light image of the selected Side C is reflected back from the exposure platen 2 and projected as an inverse or mirror image onto a discrete section of a photoconductive web 5. The photoconductive web 5 has a photoconductive or image receiving surface 9 and a transparent support backing and is trained about six transport rollers 10, 11, 12, 13, 14, and 15 as an endless or continuous belt. Roller 10 is coupled to a drive motor M in a conventional manner which is connected to a source of potential V when a switch S is closed by a logic and control unit (LCU) 31. When the switch S is closed, the roller 10 is driven by the motor M and moves the web 5 in a clockwise direction indicated by arrow 16. This movement causes successive sections of the web 5 to sequentially pass a series of electrophotographic work stations. For the purpose of the instant disclosure, the several work stations along the web's path of movement may be described as follows:

a charging station 17 at which the photoconductive surface 9 of the web 5 is sensitized by receiving a uniform electrostatic charge;

an exposing station 18 at which the inverse image of the selected side C of the original sheet S is projected onto the photoconductive surface 9 of the web 5; the image dissipates the electrostatic charge at the exposed areas of the photoconductive surface and forms a latent electrostatic image thereon which corresponds to the indicia on the selected side C of the original Sheet S;

a developing station 19 at which developing powder, including toner particles having an electrostatic charge opposite to that of the latent electrostatic image, is brushed over the photoconductive surface 9 of the web 5 and causes the toner particles to adhere to the latent electrostatic image to visibly form a toner particle or developed image which is a mirror resemblance of the indicia on the selected side C of the original sheet S;

a postdevelopment erase station 20 at which the web is illuminated to reduce photoconductor fatigue, i.e. its inability to accept or hold an electrostatic charge;

a transfer station 21 at which the developed image is electrostatically transferred from the photoconductive surface 9 of the web 5 to a receiving side C′ of a copy sheet S′ (movement of the copy sheet is checked by a registration device 22 to assure its arrival at the transfer station, from either one of two supply bins 23 and 24, coincidentally with the arrival of the developed image at the transfer station); and a cleaning station 25 at which the photoconductive surface 9 of the web 5 is cleaned of any residual toner particles remaining thereon after the developed image has been transferred and is discharged of any residual electrostatic charge remaining thereon.

The developed image, as transferred onto the copy sheet S′, has the indicia configuration as that of the original sheet S. After receiving the developed image at the transfer station 21, the copy sheet S′ is separated from the web 5 at the roller 14 and is carried by a vacuum transport 26 to a fusing station 27. The fusing station 27 serves to fix the developed image by fusing the toner particles to the receiving side C′ of the copy sheet S′. Finally, the copy sheet S′ is moved through a guide and feed roller arrangement 28 to a completed copy tray 29. As depicted in FIG. 1, the copy sheet S′ is deposited in the copy tray 29 with fixed image or receiving side C′ facing upwardly on top of an earlier, similarly deposited copy sheet.

To coordinate operation of the various work stations 17, 18, 19, 21 and 25 with movement of the image areas on the web 5 past these stations, the web has a plurality of perforations, not shown, along one of its edges. At a fixed location along the path of web movement, there is provided suitable means 30 for sensing web perforations. This sensing generates input signals into a LCU 31 having a digital computer. The digital computer has a stored program responsive to the input signals for sequentially actuating then de-actuating the work stations as well as for controlling and operation of many other machine functions as disclosed in U.S. Pat. No. 3,914,047.

Logic and Control Unit 31

Programming of minicomputers or microprocessors, such as an INTEL model 8008 or model 8080 microprocessor (which can be used in accordance with the invention), is a conventional skill well understood in the art. The following disclosure is written to enable a programmer having ordinary skill in the art to produce an appropriate program for the computer. The particular details of any such program would, of course, depend upon the architecture of the selected computer.

Figure 3:
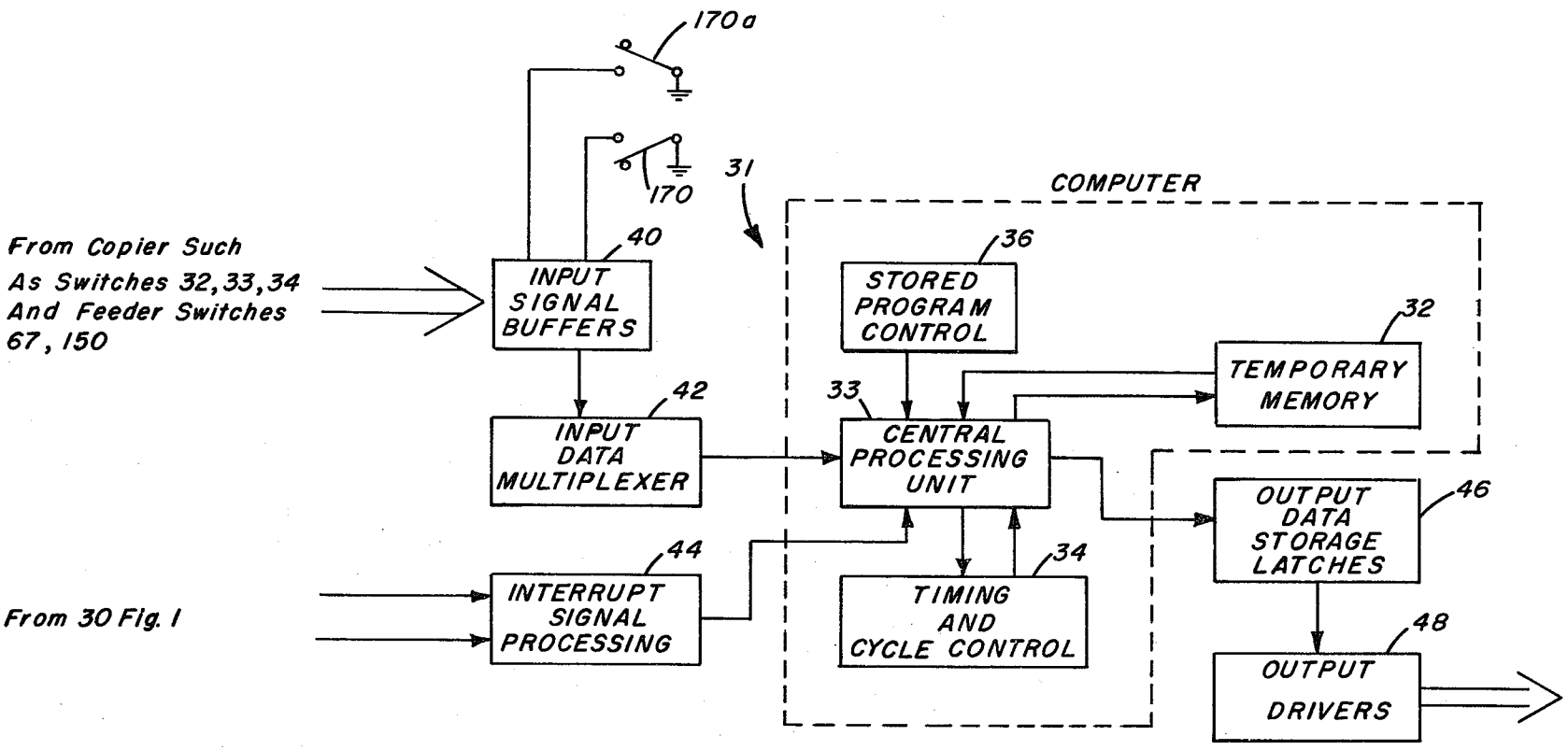
FIG. 3 is a block diagram of the logic and control unit shown in FIG. 1.

Turning now to FIG. 3, block diagram of a typical logic and control unit (LCU) 31 is shown which interfaces with the copier 1 and the feeder 50. The LCU 31 consists of temporary data storage memory 32, central processing unit 33, timing and cycle control unit 34, and stored program control 36. Data input and output is performed sequentially under program control. Input data is applied through either input signal buffer 40 to a multiplexer 42 or to signal processor 44 from perforations detected on the web 5. The input signals which are derived from various switches, sensors, and analog-to-digital converters. The output data and control signals are applied to storage latches 46 which provide inputs to suitable output drivers 48 which are directly coupled to leads which, in turn, are connected to the work stations. More specifically, the output signals from the LCU 31 are logic level digital signals which are buffered and amplified to provide drive signals to various clutches, brakes solenoids, power switches, and numeric displays in the various copier work stations and the feeder 50. The LCU 31 processing functions can be programmed by changing the instructions stored in the computer memory. This programming technique provides a flexible machine logic and timing arrangement and extends the LCU 31 capability to include the capacity for performing service diagnostics. For example, if an input signal is not delivered to the LCU 31 at the appropriate time, the LCU 31 will display an ERROR code on the control panel. The ERROR code indicates a machine failure and, during servicing, usually provides the specific nature of a machine failure. During a copy cycle, the LCU 31 executes the stored program which controls the processing of signal inputs to the LCU 31 and initiates the timed turn ON and turn OFF, of the output control signals.

The time sequence of machine control signals (often referred to in the art as events) is critical to the copy cycle because the copier and feeder stations and associated mechanisms must be powered ON and OFF in the correct sequence to assure high quality copying and to prevent paper misfeeds, misregistration, and erratic operation. One way of controlling the time sequence of events and their relationship to each other is, as noted above, to sense perforations which correspond to the location of the image elements on the web 5 as these elements continue through the cycle of the copier's endless path. Thus, the detection of perforations by a sensor 30 is applied to the LCU 31 through an interrupt circuit 44 (see FIG. 3) and is used to synchronize the various control mechanisms with the location of the image elements. These perforations generally are spaced equidistant along the edge of the web member 5. For example, the web member 5 may be divided into six image areas by F perforations; and each image area may be subdivided into 51 sections by C perforations. These F and C perforations (not shown) are described in U.S. Pat. No. 3,914,047.

Returning now to the computer, the program is located in stored program control 36 which may be provided by a conventional Read Only Memory (ROM). The ROM contains the operational program in the form of instructions and fixed binary numbers corresponding to numeric constants. These programs are permanently stored in the ROM(s) and cannot be altered by the computer operation.

Typically, the ROM 36 is programmed at the manufacturer's facility, and the instructions programmed provide the required control functions such as: sequential control, jam recovery, operator observable logic, machine timing, and automatic document rearrangement. For a specific example, the total ROM capacity may be approximately 2,000 bytes with each byte being 8 bits in length. The program may require more than one ROM.

The temporary storage memory 32 may be conveniently provided by a conventional Read/Write Memory. Read/Write Memory or Random Access Memory (RAM) differs from ROM in two distinct characteristics:

1. Stored data is destroyed by removal of power; and
2. The stored data is easily altered by writing new data into memory.

For specific example, the RAM capacity may be 256 bytes; each byte being eight bits in length. Data, such as: copy requested count, copies processed count, and copies delivered count, at the exit as indicated by the switch 34, are stored in the RAM until successful completion of a copy cycle. The RAM is also used to store data being operated on by the computer and to store the results of computer calculations.

Recirculating Feeder

The preferred embodiment of a recirculating feeder is designated by the reference numeral 50 in FIG. 1. The recirculating feeder 50 is positioned directly on top of the exposure platen 2. For access to the exposure platen 2, the recirculating feeder 50 is raised at a front end 51; the entire feeder pivots about a rearwardly located connection, not shown, with the copier 1. With this feeder 50, a plurality of sheets of a document can be repeatedly fed in succession from an originating stack to the exposure platen 2 of the electrophotographic copier 1. This is done by returning the sheets to the originating stack in the same order or sequence as they are fed from. The LCU 31 synchronizes the operation of the feeder 50 with the copier 1.

Figure 2:
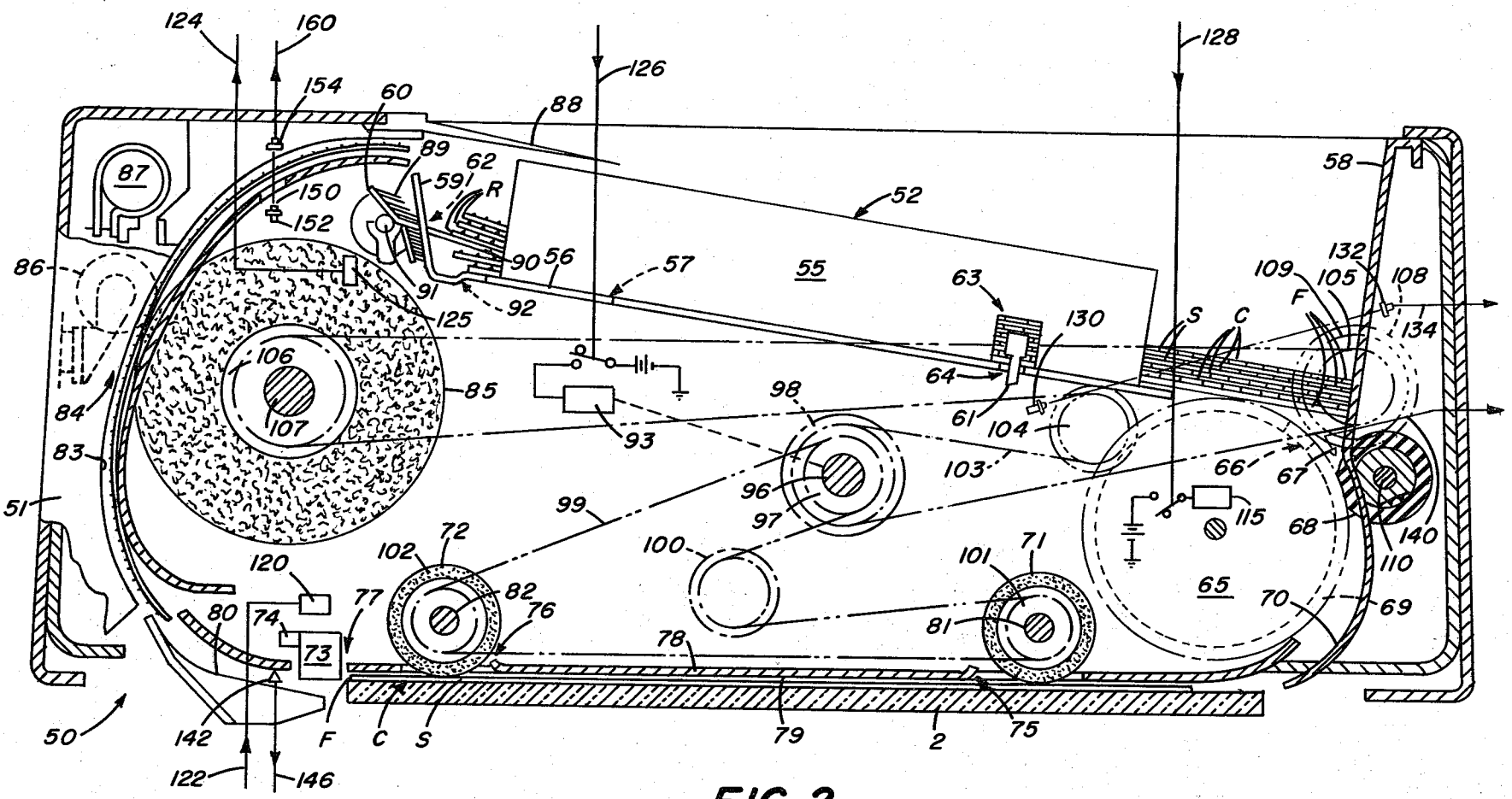
FIG. 2 is an enlarged front elevation view, partly in section, of the recirculating feeder of FIG. 1.

As illustrated in FIG. 2, the recirculating feeder 50 is loaded by placing an originating stack of document sheets S into a supply tray 52. The sheets S, stacked in the tray 52, are oriented with their respective sides C, selected for copying, facing upwardly. An air space is provided between ribs (not shown) in the bottom-most sheet in the stack and the floor plate to facilitate removal of the bottom-most sheet from the stack. The edge guides 55 are mounted in respective slots 57 in the floor plate 56 for movement toward and away from each other to accommodate different width sheet sets. The tray 52 is inclined downwardly to the right, causing the forward or leading edges F of the sheets S to reset against a forward wall plate 58. The rearward or trailing edges R of the sheets S are spaced from a rearward wall plate 59 of the tray 52. During the feeding cycle in which the sheets S are removed from the stack bottom and returned to the stack top, an end jogger 60 and a side jogger 61 separately move back and forth to align the sheets with each other in the stack. Openings 62 are provided in the rear wall plate 59 of the tray 52 and in one of the edge guides 55 for passage of the end and side joggers 60 and 61. The end joggers 60 are movably adjustable to accommodate different length sheet sets.

A rotatably supported vacuum cylinder 65 extends partially into the space between the floor plate 56 and the wall plate 58. The vacuum cylinder, which is hollow, is sealed except for a single elongate series of air intake ports 66 and an air out-take opening, not shown. Suitable conduit and gasket means, not shown, connect the air out-take opening with a vacuum source in the copier 1 for drawing air from the cylinder interior. Initially, the vacuum cylinder 65 is oriented with the air intake ports 66 in a starting position beneath the forward edge F of the bottom-most sheet S in the tray 52. Air rushing into the intake ports 66 causes this forward edge F to peel away from the stack bottom and adhere to the vacuum cylinder 65. Then, the vacuum cylinder 65 is rotated slightly in a clockwise direction to draw the bottom-most sheet S from the stack only enough to deliver its forward edge F into respective feeding nips defined by continuously rotating feed rollers 68 and backup rings 69. The remaining sheets S are prevented from separating from the stack by the engagement of their forward edge F with the wall plate 58. Backup rings 69 extend around the vacuum cylinder 65 and rotate with respect to the vacuum cylinder and about the same axis.

The backup rings 69 cooperate with the feed rollers 68 to effect complete removal of the bottom-most sheet from the stack and to feed the removed sheet along an arcuate guide 70 to the exposure platen 2. As soon as the vacuum cylinder 65 has delivered the forward edge F of the bottom-most sheet into the feeding nips, the cylinder 65 is reversed, rotating slightly in a counterclockwise direction, until the intake ports 66 are returned to their starting position. During this reverse movement of the vacuum cylinder 65, the intake ports 66 inch rearwardly along the bottom-most sheet as it is being drawn between the feed rollers 68 and the backup rings 69. After the intake ports 66 have returned to their starting position and the rearward edge of this sheet clears the ports, there is a renewed rush of air into the intake ports which peels the forward edge of the next bottom-most sheet from the stack and cause it to adhere to the vacuum cylinder 65. Then, the vacuum cylinder 65 is again rotated slightly in a clockwise direction to draw the next bottom-most sheet from the stack only enough to deliver its forward edge into the feeding nips. The feeding nips receive the forward edge of this sheet upon departure of the rearward edge of the previous sheet. Accordingly, by the sequence just described, each of the sheets S are removed one at a time from the stack bottom and fed to the exposure platen 2.

After exiting from the arcuate guide 70, each sheet S is deposited with its side C selected for copying facing downwardly on the platen 2. Two sets of continuously rotating feed rollers 71 and 72 move the sheet S, selected side C downwardly, along the platen 2 and into registraton therewith for exposure. During such registration, the sheet S lies stationary on the exposure platen 2 with its forward edge F against two registration pads 73 (only one of which is shown) which are spaced apart from each other on a registration bar 74. The registration pads 73 and bar 74 are located along the feed path at the platen end farthest removed from the supply tray 52. Because the feed rollers 71 and 72 urge the sheet S against both of the registration pads 73, any skew in the sheet S is corrected before it is exposed. Feed rollers 71 and 72 and the registration pads 73 depend through respective openings 75, 76, and 77 in a backup plate 78. This plate 78 extends substantially parallel to the platen 2. A light reflective material, serving as a light shield during exposure, is coated on the side 79 of the plate 78, which side faces the platen 2. While the registration pads 73 block movement of the sheet S, feed rollers 71 and 72 continue to rotate, slipping on the backside of the sheet. This slipping occurs for a fraction of a second during the time the sheet is stationary (between registration of the sheet and its exposure). After exposure, a pulse carried by a lead 122 from the LCU 31 actuates a solenoid 120 to retract the registration bar 74, with the registration pads 73, from the feed path and out of the way of the sheet S. Then, the rotating rollers 71 and 72 immediately expel the sheet S from the exposure platen 2 and move the sheet onto an arcuate guide 80. As shown in FIG. 2, to again move the registration bar 74 with the registration pads 73 for sheet registration, the LCU 31 deactivates the solenoid 120.

In the upper left hand portion of FIG. 2 there is shown a separator member 90 which extends through the opening 62 in the rearward wall plate 59 into the originating stack in the supply tray 52. The bottom surface of separator member 90 initially engages the top sheet of a document stack. At the rearward edges R, the separator member 90 separates the documents S in the stack which have been exposed from those which remain to be exposed. The separator member 90 is fixed to a rotatable support shaft 91. As viewed in FIG. 2, as the documents S are fed in succession from the stack bottom to the exposure platen 2 and returned singly to the stack top, the separator member 90 rotates incrementally in a clockwise direction at the shaft 91. When the last sheet to be exposed is fed from the stack bottom, the separator member 90 drops through an opening 92 in the floor plate 56 of the supply tray 52. Where two or more feeding cycles are required or several collated copies of a multi-page document are desired, after the last sheet to be exposed a first time is returned to the stack top, the separator member 90 is moved by suitable drive means, not shown, onto the topmost sheet in the stack. When the separator member 90 drops through the opening 92 in the floor plate 56, a micro switch 125 is actuated. This switch actuation provides a pulse to the digital computer in the copier 1 on line 124, as shown in FIG. 1, and indicates to the computer that a single sheet set has been copied. The computer totalizes the number of copy sets which have been made. At the end of the copy job, the computer recognizes concurrence between the number of sensed switch actuations and the number of sheet set copies requested by an operator. Then, after the last sheet to be exposed is returned to the stack top, the recirculating feeder 50 is deactivated.

A drive shaft 96 and two side-by-side drive pulleys 97 and 98 are rotated by a drive motor 93 which has been energized by a source of potential in the lead 126 from the LCU 31. Rotation of the drive pulley 97 moves an endless drive belt 99 which rotates a belt tensioning pully 100 and two roller pulleys 101 and 102. By rotating the roller pulleys 101 and 102, the roller shafts 81 and 82 are rotated with the feed rollers 71 and 72. Also, rotation of the drive pulley 98 moves an endless drive belt 103 which rotates a belt tensioning pulley 104 and two roller pulleys 105 and 106. By rotating the roller pulley 106, a roller shaft 107 is rotated with the feed rollers 85. Rotation of the roller pulley 105 rotates two engaging gear wheels 108, with only one of the wheels 108 being shown and 109. By rotating the gear wheel 108, a roller shaft 110 is rotated with the feed rollers 68.

As is more fully disclosed in U.S. Pat. Application Ser. No. 647,683 a drive mechanism is provided for intermittently oscillating the vacuum cylinder 65 to deliver the forward edges of the sheets, one at a time, from the originating stack to the feeding nips (of the shaft for the cylinder 65) is connected to an electric, one-revolution clutch 115. When energized by the LCU 31 through lead 128, the clutch causes an intermittent drive mechanism connected to the cylinder 65 to rotate back and forth once. This rotation of this intermittent drive mechanism causes a sheet to be fed to the exposure platen 2.

Feeder Operation, Logic and Jam Detection

The feeder 50 enables the copier 1 to make collated or noncollated sets of copies. In the feeder, a plurality of sensors along the document sheet feed path provide inputs to the LCU 31. Next to the tensioning pulley 104 is a light emitting diode LED 130 which directs a beam of light towards a photocell 132. If no document is present, the photocell 132 signals the LCU 31 over lead 134 that the document supply is empty. The LCU 31 will then shutdown the feeder by de-energizing the clutch 115. A microswitch 67 is disposed adjacent the feeding nips of the feeding rollers 68 and backup rings 69. When a document sheet S passes by this switch 67, the switch closes and a logic "1" is sent to the LCU 31 a lead 140. When no document is at this position in the feed path, the lead 140 indicates a logic "0" to the LCU 31. Located immediately after the registration pads 73 is a microswitch 142 which provides similar signals to the LCU 31 over lead 146. The purpose of this microswitch 142 is to tell the LCU if a document sheet has cleared the platen 2. (The use of the switch 142 is not critical and may be eliminated.) Finally, near the supply tray 52 there is provided a return switch 150 which includes an LED 152 and a photocell 154. The photocell 154 sends logic signals "1" and "0" to the LCU 31 over lead 160, indicating the presence or absence of a sheet, respectively, at this position. In order to determine if there has been a document sheet jam in the feeder 50, the leads 140 and 160 are sampled by the LCU 31 at the appropriate times in accordance with the perforations on the copier web 5 to see if each fed document has cleared each of these positions. If a document sheet has not cleared each position, a jam is indicated and the feeder is "hard shutdown". However, the copier is permitted to complete the copies in process. The logic "1" signals from the switch 150 are also stored and accumulated by the LCU 31 in a location of temporary memory 32 to indicate the total number of document originals which have been exposed at the platen 2. This cumulative total is used in the automatic rearrangement apparatus, as will be described later in this specification.

The feeder 50 can operate in collate and noncollate modes. Both modes of operation are quite similar. The events relative to the position of a document sheet along the feed path are as follows:

1. After document sheets S are placed in the document tray, the photocell 132 signals the LCU 31 over lead 134 that documents are present. Now, an operator can select either the collate or noncollate mode by depressing the appropriate button on the feeder control panel, not shown.

2. After the copier start button is depressed, the LCU 31 energizes the solenoid 120, motor 93, and clutch 115, as well as a vacuum blower motor, not shown, and causes the separator member 90 to be reset to the top of the document stack. This will be referred to as its initial position. After the vacuum has had time to reach its proper level, the LCU 31 issues the first document sheet feed command. The bottom-most document sheet in the document tray is fed past the Fed/Registered Sensor (at position 67) and is registered against the pad 73.

3. A document sheet is exposed once in the collate mode and returned to the top of the stack. In the noncollate mode, a document sheet is exposed a number of times until the copies processed count (the number of exposure flashes) equals the copies requested count. (Both of these counts are in temporary storage memory 32 of the computer). After the appropriate number of copies are made, the pads 73 are lifted as the LCU 31 energizes solenoid 120; and the document sheet is returned to the document tray past the platen clear switch 142 and return switch 150.

4. Now, the second feed command is given and the second original is fed to the platen 2. Continuity in the feeder operation is maintained by setting the first original sheet on top of the stock before the trailing edge of the second document sheet leaves the stack.

5. In the collate mode, the feeding process continued until the sets processed (i.e. the number of signals from the miscroswitch 125) coincides with the sets requested. In the noncollate mode, the feeding process continues until all document sheets in the document tray have been fed as indicated by a single signal from the switch 125.

6. When the feeding process is complete, the feeder is turned "OFF".

7. If a paper jam occurs in the feeder, the feeder drive motor 93 and blower motor are immediately turned "OFF". The copier is allowed to clear itself of copies before being turned "OFF". A visual signal appears on the operator panel to alert the operator to clear the jam.

Figure 4:
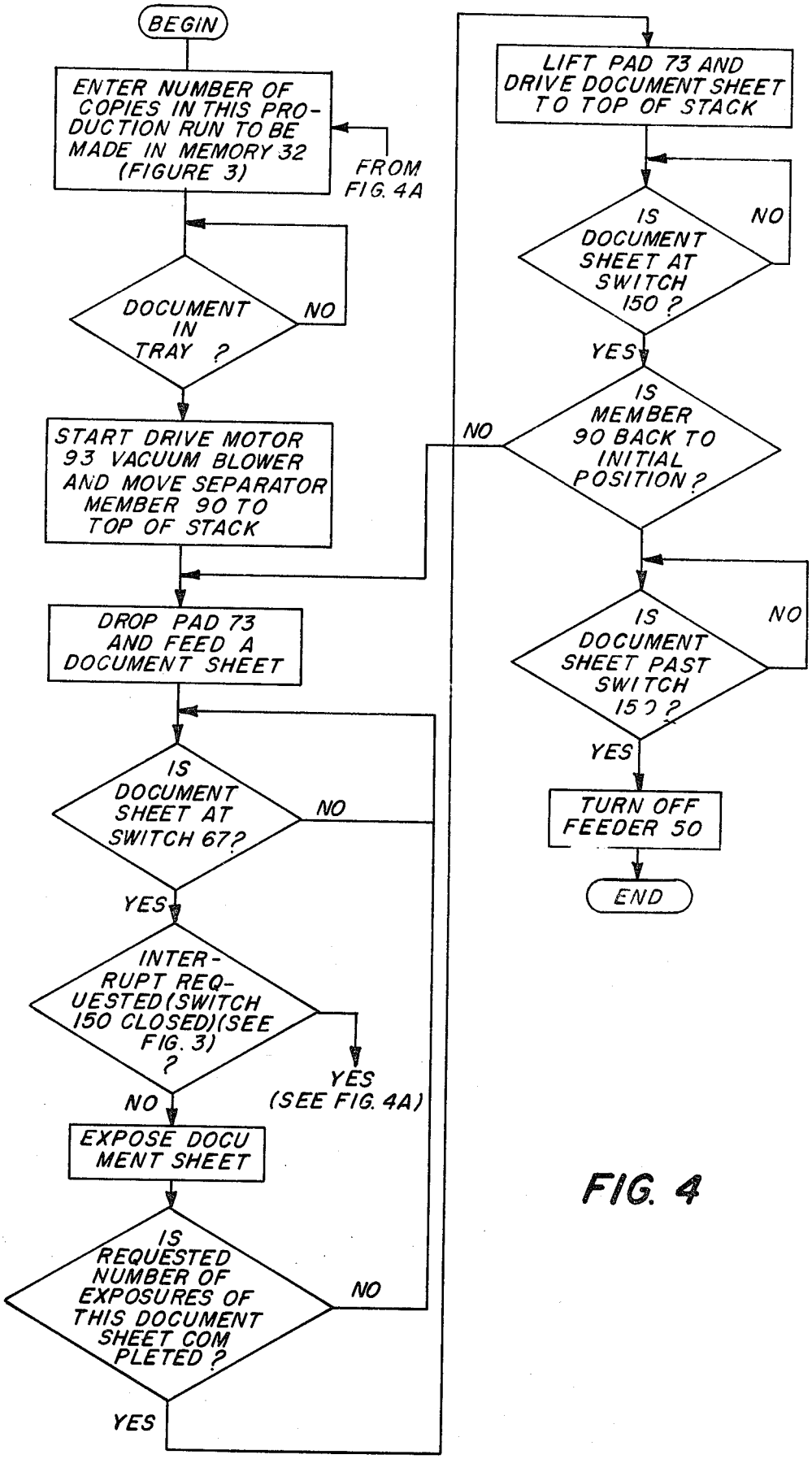
FIG. 4 is a flow chart of the noncollate mode of operating the feeder and copier of FIG. 1.

Turning now to FIG. 4, there is shown the flow chart for the operation of the feeder 50 in a noncollate mode to operation. To "BEGIN" this operation an operator enters the information of a noncollate copy run and the number of copies to be made of each document sheet. The first decision that LCU 31 makes is if there are document sheets in the tray 52 by sampling the lead 134 connected to the photocell 132 to determine if it is in a logic "1" or a logic "0" state. If there are no document sheets in the tray 52, the feeder cannot be started. However, if there are document sheets in the tray 52, the LCU 31 energizes the drive motor 93 and the vacuum blower and causes the separator member 90 to move to the top of the stack. Next, the LCU 31 de-energizes the solenoid 120 which drops the pads 73 and also energizes the clutch 115 which causes a document sheet to be fed from the bottom of the stack along the feed path. At the appropriate time as determined by perforations in the web 5, the LCu 31 samples the lead 140 to determine if a document sheet is at the switch 67. If a document sheet S is not at the switch 67 or is jammed at the switch 67, as discussed above, the machine will be shutdown as will be explained further with reference to FIGS. 6 and 8.

Assuming the document sheet has passed the switch 67 correctly and is now located at the exposure platen 2, the LCU 31 checks to see if the switch 150 has been closed. If so the logic branches to FIG. 4A which will be discussed shortly. A document sheet is now exposed. The next decision in FIG. 4 is requested number of exposures of this document sheet completed. This is done by the LCu 31 after each exposure, by checking, to see if the process count equals the copies requested count. If the LCU 31 determines that more copies are to be made, the exposures of such copies are made until the counts are equal. At such time, the solenoid 120 is energized and the document sheet at the exposure platen 2 is driven toward the top of the stack. The computer will then check to see if this document sheet has advanced to the switch 150. If the document sheet does not clear the switch 150, a jam will be indicated. The next decision the LCU 31 makes is if the separator member 90 has not been driven back to its initial position, indicating the completion of a copy run. If the separator member 90 has not been driven back to its initial position, the LCU 31 will energize the drive motor 93 and the vacuum blower and cause the separator member 90 to in its initial position, the switch 150 will be sampled again to assure the computer that the last document sheets has in fact cleared the switch 150. If the document sheet has not cleared the switch 150, and appropriate indicator on the operator panel will be illiminated. In either case, the feeder will be stopped.

Figure 4A:
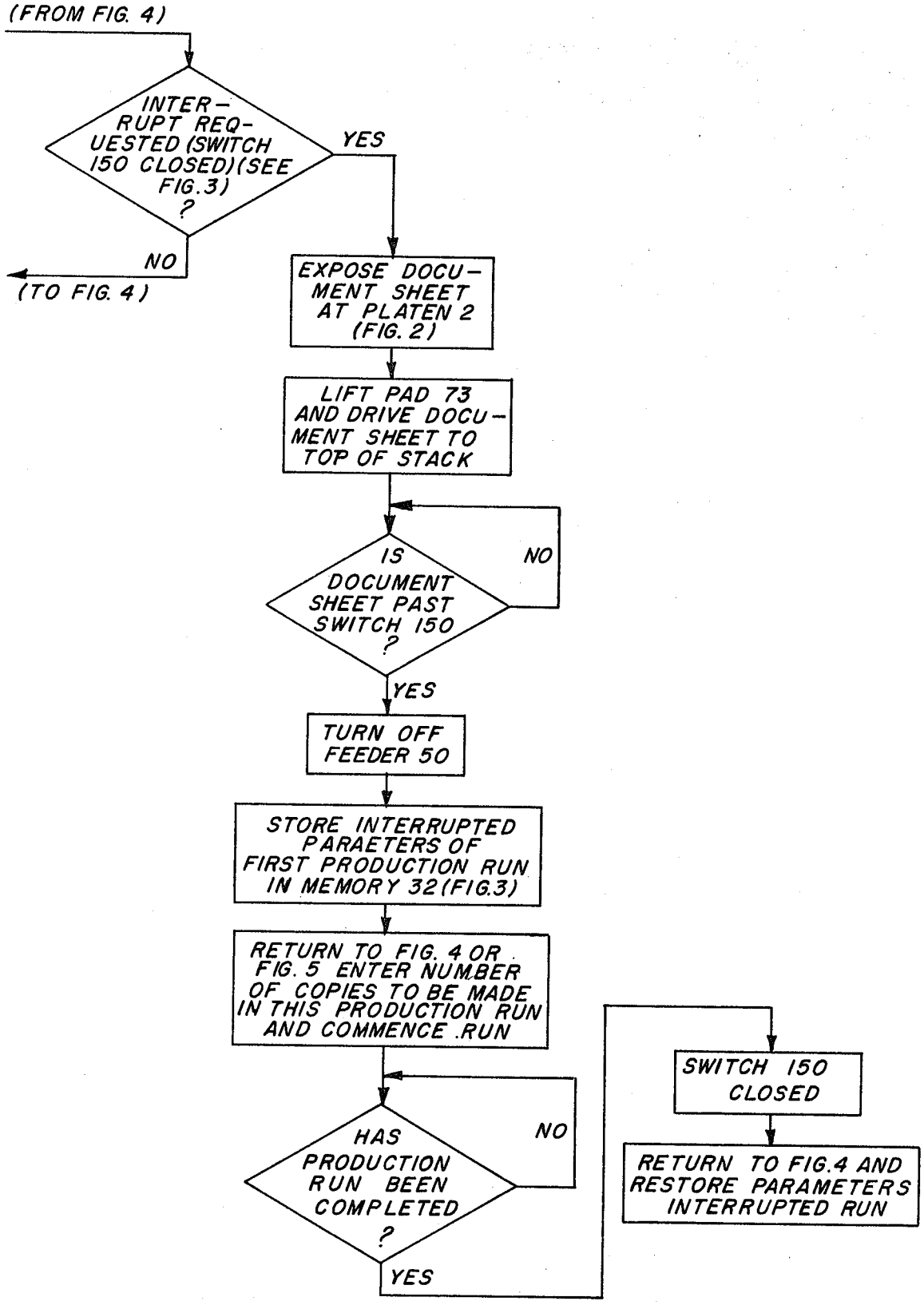
FIG. 4*a* shows a flow chart of an interrupt on the noncollate mode of operation.

FIG. 4A show the flow chart sequencing for the priority interrupt apparatus and is operative after the interrupt switch 170 has been closed. The document sheet at the platen 2 is exposed and then returned to the top of the stack. The feeder 50 is then turned off. Next the interrupted parameters (i.e. the number of copies to be made and the number currently completed) are entered in a dedicated position of memory 32. The next interrupting production run or runs are then entered and completed. When the switch 170*a* (see FIG. 3) is closed, the interrupted parameters are transferred from their dedicated memory position to the operative memory position depicted as the second block from the top of FIG. 4. The interrupted production run is now completed.

Figure 5:
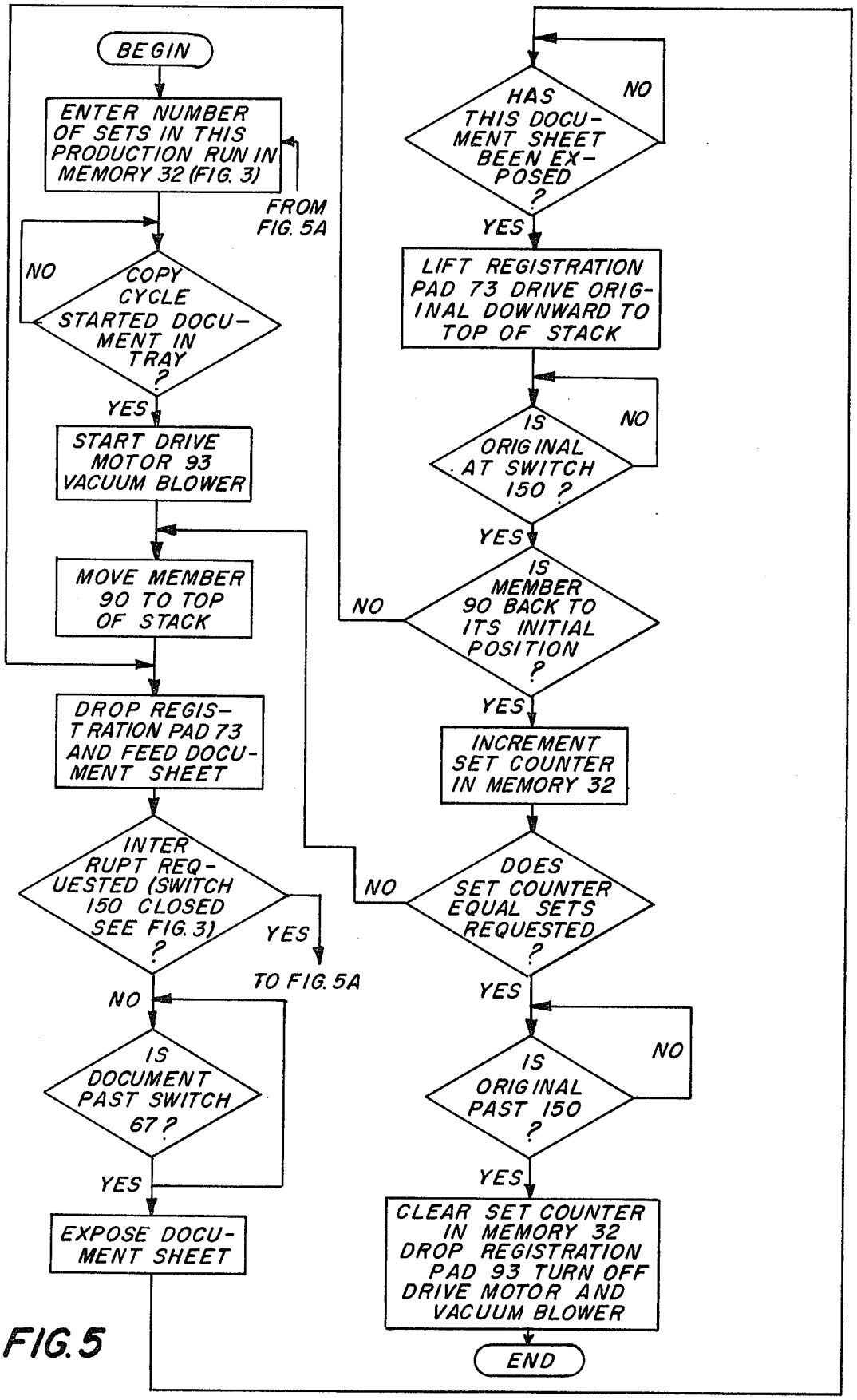
FIG. 5 is a flow chart of the collate mode of operating the feeder and copier of FIG. 1.

FIG. 5 shows the flow chart for the feeder operation in the collate mode of operation. Many of the functions of the collate mode of operation are identical to those of the noncollate mode of operation in FIG. 4 and, therefore, need not be described. As indicated in FIG. 5, (but see also FIG. 2), after the separator member 90 has returned to its initial position at the top of the stack, no interrupt is requested and the advance document sheet is not jammed at switch 67, the sheet is exposed. Assuming the sheet has been properly returned to the stack, and member 90 is not back in its initial position, the logic branches back to just prior to feeding a document sheet. If the member 90 is back in its initial position, a set is completed and the lead 124 provides a signal to the LCU 31 which stores a count in a memory location of the temporary storage memory 32. In effect, this signal from the lead 124 to the LCU 31 causes the set count to be incremented by one. The computer then asks the question, is the set count equal to the number of sets requested. If the answer to that question is not, the flow chart branches back to the position in FIG. 5, just prior to moving member 90 to its initial position and the process of making copies is repeated. If the answer to the question is yes, the switch 150 will be checked for a paper jam at its location. If no paper jam exists at switch 150, the LCU 31 will clear the set counter, drop the registration pads 73, and turn off the drive motor 93 and the vacuum blower; thus, stopping the feeder.

To summarize, the following steps compare the operation of the feeder when operating in noncollate and collate modes.

| NONCOLLATE | COLLATE |
|---|---|
| (1) Requested/processed displays on copier indicate copies per original requested/processed. | (1) Requested/processed displays on copier indicate sets requested/processed. |
| (2) Requested copies per original for each original in document stack. | (2) One copy per original for each original in document stack for all sets requested. |
| (3) Document sheet is returned to stack after requested exposures/original is complete. | (3) Document sheet is returned to stack after one exposure. |
| (4) Set counter indicates noncollated sets complete. Feeder process complete. | (4) Set counter counts sets delivered. |

Figure 5A:
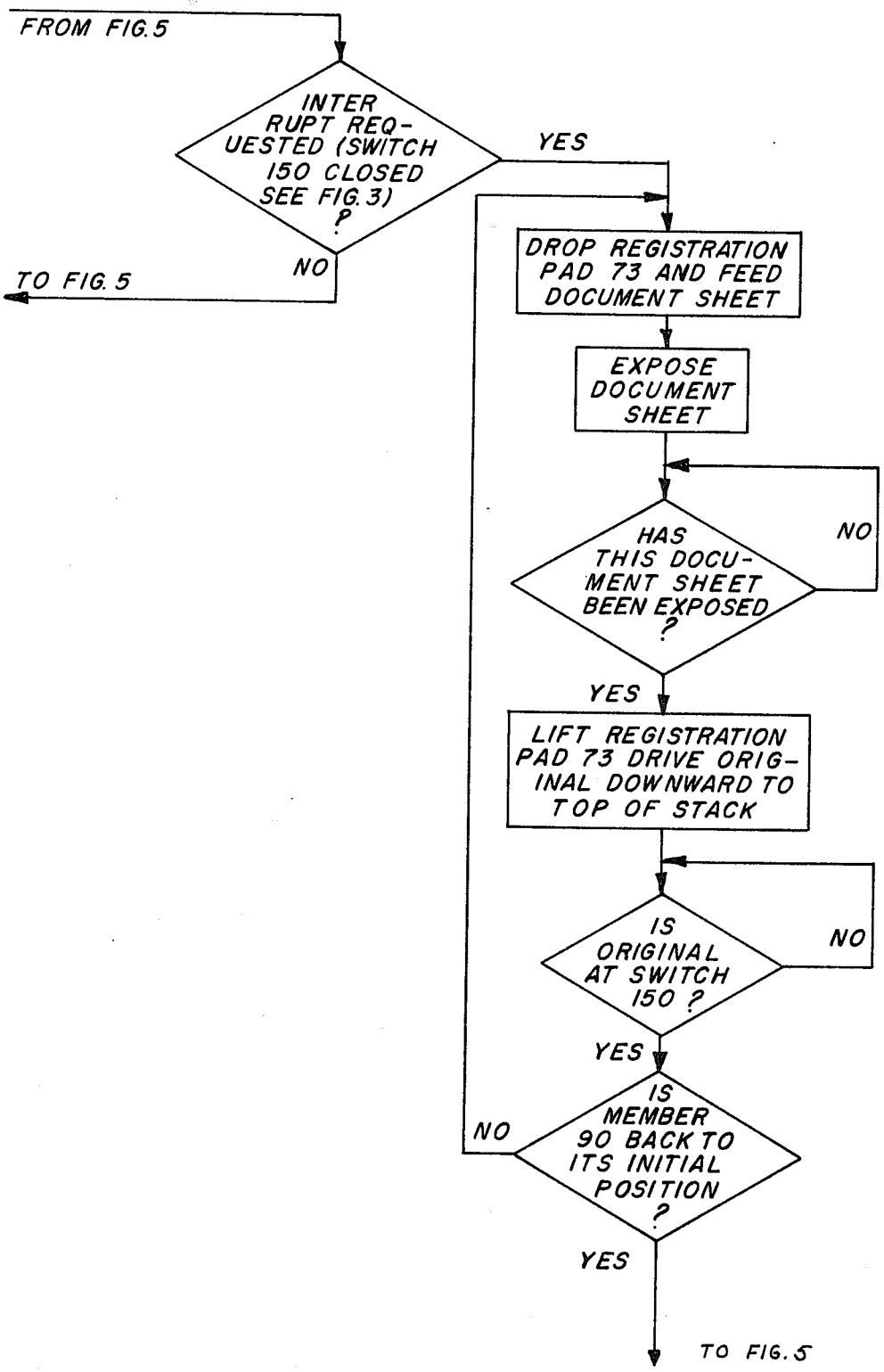
FIG. 5*a* show a flow chart of an interrupt sequence in the collate mode of operation.

The sequencing for priority interrupt apparatus in the collate mode is shown in FIG. 5A. Assuming there has been an interrupt request, (i.e. switch 170 being closed) the logic is configured to complete the document set in process then interrupt. Thus a document sheet is fed, exposed and returned to the stack. If a set is not completed the process is repeated until the set is completed. After a set is completed, if the set counter equals the sets requested the production run is completed and the feeder is shut off and the operator is signaled that the production run is completed. If the run is not yet done, the interrupted parameters such as the number of sets completed and the number of sets requested are stored in dedicated storage locations in the temporary memory 32. Now other producton run(s) can be completed. As shown in FIGS. 4 and 5, when switch 170a (See FIG. 3) is closed and the process production run is completed, the interrupted parameters stored in the memory 32 are restored and the logic branches back to FIG. 5, and the copy cycle is started and run to completion. The following is a discussion of the logic flow for the feeder.

DOCUMENT REARRANGEMENT

Figure 6:
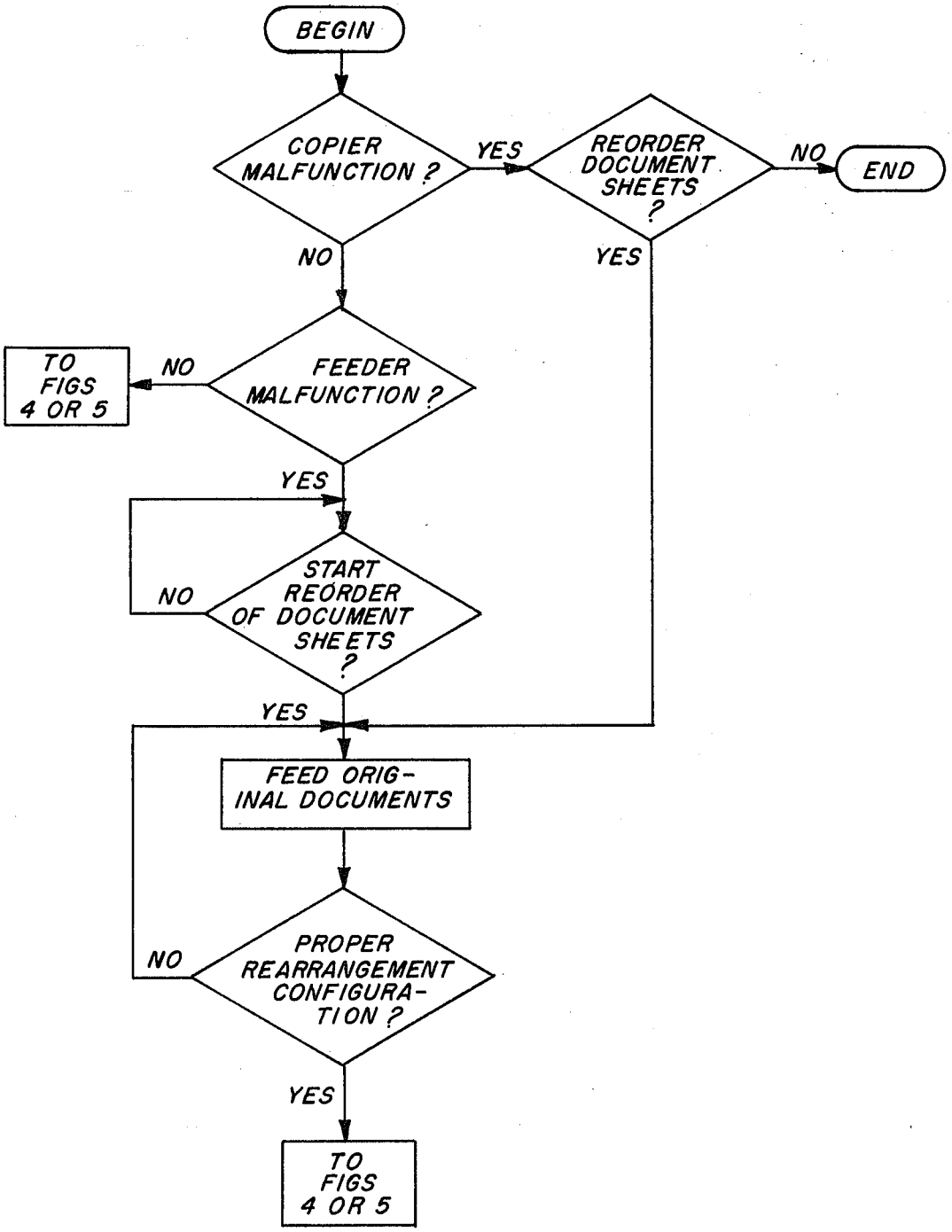
FIG. 6 is a simplified flow chart illustrating the general logical sequence for rearranging documents sheets in the recirculating feeder after a jam has occurred in either the feeder or copier.

Turning now to FIG. 6, there is shown a simplified flowchart of the logic sequence of the document feeder rearrangement apparatus. Assuming that the copier has begun its operation, the LCU 31 checks the copier 1 and the feeder 50, respectively for malfunctions. The machine will proceed with its operation until the copy run is completed if no malfunctions have occurred. Let us assume tha the LCU 31 has detected a copier malfunction. The malfunction may be of the kind which will not interfere with the continuity of copying. After this malfunction is corrected, the feeder and copier resume operation. If one of the jam sensors 32, 33, 34 detects a paper jam, the copier 1 will be "hard shutdown" . Even prior to the correction of the jam, the LCU 31 will signal the feeder 50 to feed original document sheet in a reordering sequence. It must be realized that the computer knows the copy count of copies which have exited from the copier past the switch 34 and the number of copy sheets which have passed by switch 32. Thus, the computer causes the feeder 50 to rearrange the document sheets until the bottom-most document sheet in the stack corresponds to the next document sheet to be copied. When there is a proper rearrangement configuration, the machine will wait until the paper jam is corrected. After the paper jam is corrected and the start button is depressed, copying will continue as in FIGS. 4 or 5.

Returning now to the beginning of the logic diagram, assume that there has been a malfunction in the feeder caused by a document sheet jam. The feeder will be shutdown, but the copier will continue operating until all of the copies in process have been completed. The operator removes all document sheets from the feeder and replace them in their initial order. Here again, the LCU 31 knows which copies have been copied and will set the number of copy sheets which have been fed past switch 32 equal to zero. The LCU 31 then causes the feeder to rearrange the documents until the appropriate document sheet is at the bottom of the stack. Alternatively, the operator could just remove the jammed sheets, and place the jammed sheets on top of the stack; the LCU 31 would cause the feeder to cycle the documents sheets back to their initial position.

If single-sided copies or the first sides of doublesided copies are to be made, the computer accumulates the total number of copies that pass the exit switch 34 of FIG. 1. If a paper jam occurs in the copier 1, the operator removes all copy sheets in the copy paper feed path (which may for example be as many as six) and throw the removed sheets away. Then, the automatic rearrangement apparatus will recirculate the copies from the bottom of the stack until the total number of copies which have passed the switch 150 equals the total number of copies which have passed the switch 54. At this point, the document sheets in the feeder have been rearranged.

To copy the second sides of a duplex (double-sided) copy run, the operator places the first-sided copies in one of the bins 23 or 24. Now, copying of the second side of the duplex copy run can begin. The computer counts the number of copies that pass the switch 32; the total number will be used to rearrange the documents if a paper jam occurs.

In a copier jam situation, the operator will remove and dispose of all copies in the feed path. The next image to be exposed must correspond to the already processed firstside image of the copy to be fed. When the copy run is completed, there will, of course, be missing copies from the set. The operator will have to complete these missing copies at a later time.

Figure 7:
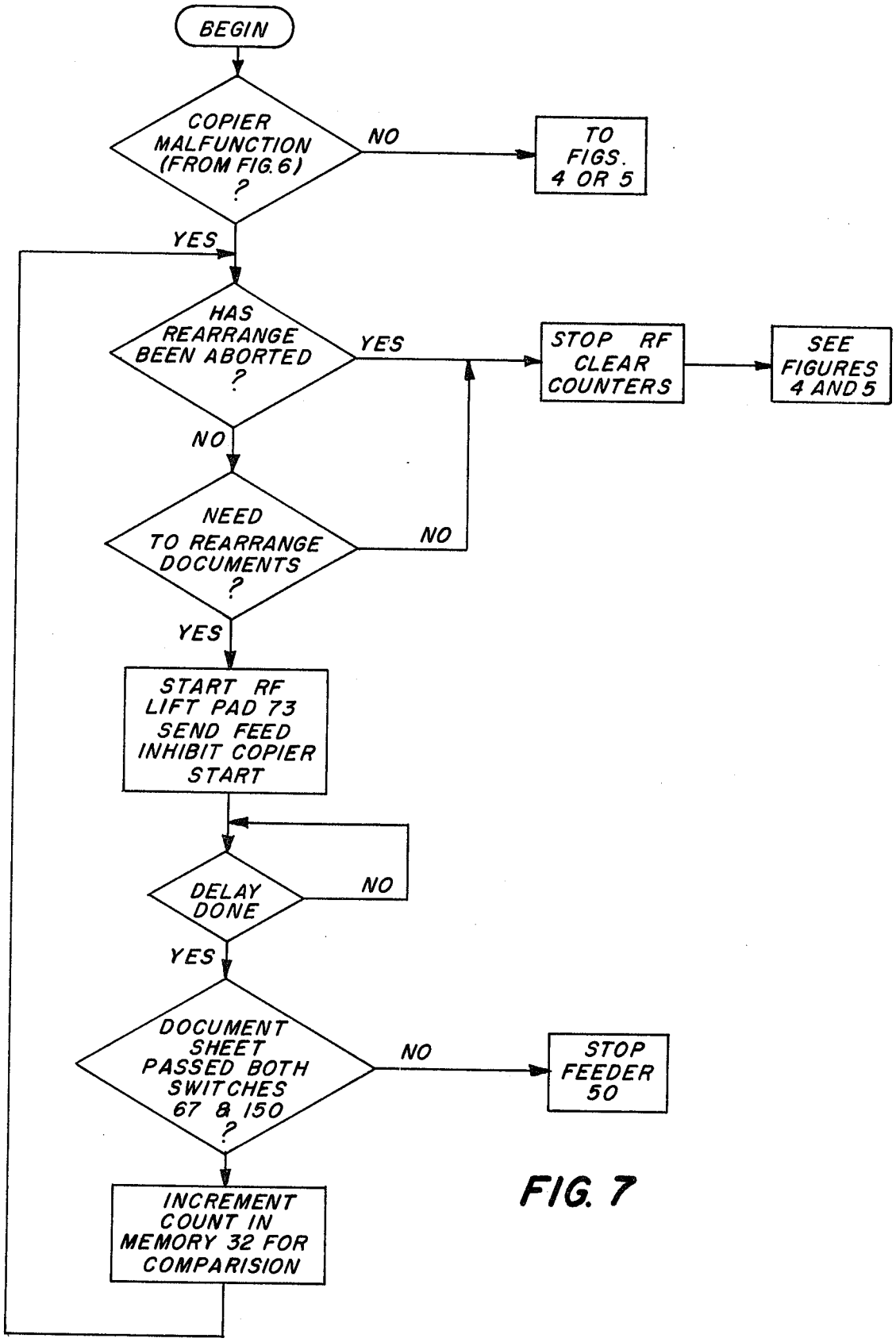
FIGS. 7 and 8 are flow charts, in more detail, of portions of the sequencing operations illustrated in FIG. 6 when malfunctions have occurred in the feeder or the copier, respectively.

Turning now to FIG. 7, there is shown in detail the FIG. 6 block reorder for document sheets when there is a copier malfunction. The first decision that is made is whether there has been a copier malfunction. The operation proceeds as in FIGS. 4 or 5 if there has not been a malfunction. If there has been a malfunction, the LCU 31 checks to see whether the operation has depressed an abort or cancel switch. If, for any reason, the operator has decided to abort or cancel the run, the LCU 31 will stop the recirculating feeder and clear all counters. Now, when the operator enters new information concerning a run, the machine will function in accordance with the flow charts of FIGS. 4 and 5. If the run has not been aborted, the LCU 31 will determine whether the documents need to be rearranged. If rearrangement is unnecessary, the operation of the feeder will proceed as in the flow charts of FIGS. 4 or 5. If rearrangement is necessary, the LCU 31 energizes the motor 93, clutch 115, and the blower motor, causes the pads 73 to be lifted, and causes a document sheet to be recirculated. After an appropriate delay, the computer determines if this document sheet has passed switches 67 and 150. If the document sheet has not passed switches 67 and 150, the feeder is stopped and a feeder jam is indicated. If the document sheet has successfully passed the switch 150, the switch 150 provides an incremental count signal to the computer. The incremental count signal in a single-sided run or the first pass of a duplex run is compared with the cumulative count of signals from switches 34 or 32, respectively. When the switch 150 signal counts are equal to the cumulative total counts from switches 34 or 32, and when the computer program logic returns to the decision block of whether or not the document sheets need to be reordered, the logic will branch to the flow charts of FIGS. 4 or 5. If these counts are not equal, the flow chart will proceed as discussed above until these counts become equal.

Figure 8:
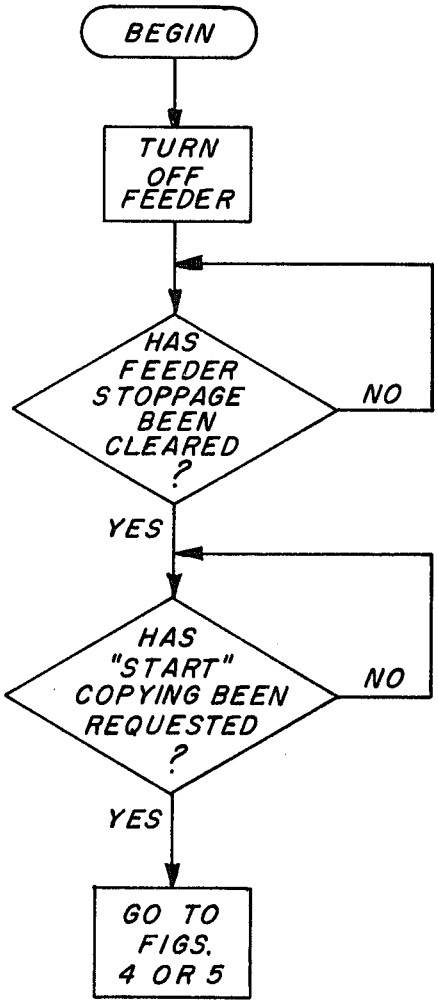

FIG. 8 shows a flow chart for the mode of operation when there has been a malfunction in the feeder. "Begin" indicates a malfunction. The LCU 31 then turns off the feeder. The next step requires an operator to clear the malfunction, such as a paper jam, and replace the document sheets in their initial order in the feeder. Finally, the operator depresses the "start" button. The logic branches and the operation continues as in FIGS. 4 and 5.

The invention has been described in detail with particular reference to a preferred embodiment thereof, but it will be understood that variations and modifications can be effected within the spirit and scope of the invention. For example, the priority interrupt apparatus can be employed in copier/duplicators which do not use feeders. Further if a feeder (or recirculating feeder) is used, document positioning apparatus can be provided to automatically move an interrupted document to an inoperative position. Then, at the appropriate time in response to the LCU this positioning apparatus would return the document to an operative so that the remaining copies of the first production run can be completed. Still further, in this specification the interrupted parameters are indicated to be the number of copies (or sets) requested and the number of copies (or sets) delivered. However other parameters could also have stored in memory and retrieved upon completion of an interrupted run. Such parameters might include.

- Paper supply selected
- Exit selected
- Copying mode selected (one or two-sided)
- Status of two-sided if selected
  - front side
  - back side
  - recopy
  - paper fed count
- Billing data
- Illumination level Upon resumption after an interrupt these parameters would simply be reinstated by the computer. Furthermore, the LCU 31 may add some mechine control feature in response to the interrupt mode such as by constraining certain activities. For a specific example, feeding from the upper paper supply can be inhibited when the copier/duplicator is producing the second side during two-sided copying prior to interrupt. An alternate exit could also be evoked so as to not mix production runs in one exit hopper. If on-line finishing is being employed for both jobs opposite offset could be evoked to separate the production runs.

I Claim:

1. In copier/duplicator apparatus for producing production runs having predetermined copies of documents, priority interrupt apparatus for interrupting a first lower priority production run and producing a second higher priority production run and thereafter completing the first production run comprising:

(a) memory means for receiving and storing first and second individual production run signals indicating the number of copies of first and second documents to be made respectively;

(b) switch means effective when actuated for producting a first production run interrupt signal indicating that a second production run has a higher priority than said first production run;

(c) means responsive to said interrupt signal for stopping said first production run and for storing in said memory means production run completion signals which are a function of the remaining number of copies of said first production run which have to be made;

(d) means responsive to said second production run signals for causing said copier/duplicator to complete said second production run; and (e) means conditioned after said second production run has been completed to be responsive to said completion signals for causing said copier/duplicator to complete the remaining copies of said first production run.

2. In a recirculating feeder for use with a copier/duplicator which is adapted to produce first and second production runs each having predetermined copies of documents, priority interrupt apparatus comprising:

(a) switch means effective when actuated for producing a first production run interrupt signal indicating that a second production run has a higher priority then a first production run;

(b) logic and control means including:

(i) memory means;

(ii) means responsive to said interrupt signal for stopping said first production run and for storing in said memory means production run completion signals which are a function of the remaining number of copies of said first production run which have to made; and (iii) means responsive to said second production run signals for causing said feeder and said copier/duplicator to complete said second production run; and (iv) means conditioned after said second production run has been completed to be responsive to said completion signals for causing said feeder and said copier/duplicator to complete the remaining copies of said first production run.

3. For use with a feeder and a copier/duplicator which is adapted to produce production runs having predetermined copies of multi-sheet documents, and wherein said feeder sequentially recirculates document sheets of a document placed in a tray from said tray to an exposure platen and back to said tray and being selectively operable in a first or second recirculating modes for recirculating sheets of a document in such a manner to produce collated or noncollated copies, respectively, from said copier, priority interrupt apparatus comprising:

(a) switch means effective when actuated for producting a first production run interrupt signsl indicating that a second production run has a higher priority then a first production run in process;

(b) logic and control means including:

(i) memory means;

(ii) means responsive to said interrupt signal for causing said feeder to stop said first production run and return all document sheets of a first document to said tray; and for storing in said memory means production run completion signals which are a function of the remaining number of copies of said first production run which have to be made; and (iii) means responsive to second production run signals after a second document has been placed in said tray for causing said feeder and said copier/duplicator to complete said second production run; and (iv) means conditioned after said second production run has been completed and said first document returned to said tray to be responsive to said completion signals for causing said feeder to recirculate document sheets to properly arrange the order of the sheets of said first document in said tray and then cause said copier/duplicator to complete the remaining copies of said first production run.

* * * * *